US010801682B1

(12) United States Patent
Allen et al.

(10) Patent No.: US 10,801,682 B1
(45) Date of Patent: Oct. 13, 2020

(54) LIGHTED RING

(71) Applicant: Research & Design Innovations, LLC, Branford, CT (US)

(72) Inventors: Donald Terry Allen, Madison, CT (US); Kevin Hannula, Bloomington, IN (US)

(73) Assignee: Research & Design Innovations, LLC, Branford, CT (US)

( * ) Notice: Subject to any disclaimer, the term of this patent is extended or adjusted under 35 U.S.C. 154(b) by 0 days.

(21) Appl. No.: 16/150,369

(22) Filed: Oct. 3, 2018

Related U.S. Application Data

(63) Continuation-in-part of application No. 15/249,652, filed on Aug. 29, 2016, now Pat. No. 10,279,877.

(60) Provisional application No. 62/211,380, filed on Aug. 28, 2015, provisional application No. 62/219,414, filed on Sep. 16, 2015.

(51) Int. Cl.
*F21S 8/08* (2006.01)
*F21V 19/00* (2006.01)
*B63B 45/04* (2006.01)

(52) U.S. Cl.
CPC ..... *F21S 8/088* (2013.01); *B63B 45/04* (2013.01); *F21V 19/009* (2013.01); *F21V 19/0055* (2013.01)

(58) Field of Classification Search
CPC ..... F21S 8/088; B63B 45/04; B63B 45/06; B63B 17/04; B63B 29/06; B63B 45/02; F21V 19/0055; F21V 19/009; A01K 97/10
See application file for complete search history.

(56) References Cited

U.S. PATENT DOCUMENTS 6,682,204 B2 * 1/2004 Mullally ..... F21V 15/01 362/235
9,885,470 B1 2/2018 Jean
2003/0081401 A1 5/2003 Camarota
2005/0117326 A1 * 6/2005 Ma ..... F21V 33/006 362/102
2006/0144315 A1 7/2006 Garelick
2015/0043209 A1 2/2015 Nirenberg

* cited by examiner

*Primary Examiner* — Isiaka O Akanbi
*Assistant Examiner* — Nathaniel J Lee
(74) *Attorney, Agent, or Firm* — DeLio Peterson & Curcip LLC; Thomas E. Ciesco

(57) ABSTRACT

A lighted ring for a post comprising a mounting ring securable on a column of the post, the column extending upwardly from a post base, a cylindrical light transmission module securable to the mounting ring and a light source disposed adjacent the light module. The light source provides illumination of an area adjacent the post through the chamfer. The light transmission module may include an inner wall, a catch spaced axially outward from the inner wall the catch having an inwardly facing protrusion along an upper portion of the catch, a groove extending the entire circumference of the light transmission module between the inner wall and the catch, an outer wall spaced axially outward from the catch and a chamfer along a bottom edge of the light transmission module and a light module slot extending along a portion of the inner wall.

28 Claims, 8 Drawing Sheets

LIGHTED RING

BACKGROUND OF THE INVENTION

1. Field of the Invention

The present invention relates generally to illuminating boat surfaces and more specifically to illuminating boat surfaces using a lighted module disposed on a post such as a seat pedestal, stanchion or other column structure.

2. Description of Related Art

Companies manufacture boating accessories having a post structure such as seat pedestals, stanchions and the like with the devices installed before or after boat assembly. The seat pedestals, stanchions or other post may be mounted on the boat as delivered to the customer or may be provided as optional add-ons or aftermarket items.

SUMMARY OF THE INVENTION

Bearing in mind the problems and deficiencies of the prior art, it is therefore an object of the present invention to provide a method for lighting a boat surface.

It is another object of the present invention to provide a post such as a seat pedestal or stanchion having an illuminated portion for aesthetic and lighting purposes.

A further object of the invention is to provide a post having an illuminated portion for allowing a passenger or crew member to easily identify the post in low lighting conditions.

It is yet another object of the present invention to provide an illuminated post for allowing boaters to see a walkway in low light conditions.

Still other objects and advantages of the invention will in part be obvious and will in part be apparent from the specification.

The above and other objects, which will be apparent to those skilled in the art, are achieved in the present invention which is directed to a lighted ring for a post comprising a mounting ring securable on a column of the post, the column extending upwardly from a base, a cylindrical light transmission module securable to the mounting ring and a light source disposed adjacent the light module. The light source provides illumination of an area adjacent the post through the chamfer. The light transmission module may include an inner wall, a catch spaced axially outward from the inner wall the catch having an inwardly facing protrusion along an upper portion of the catch, a groove extending the entire circumference of the light transmission module between the inner wall and the catch, an outer wall spaced axially outward from the catch and a chamfer along a bottom edge of the light transmission module and a light module slot extending along a portion of the inner wall. The light source may provide illumination of an area adjacent the post through the chamfer. The lighted ring may include a grommet disposed in the light module slot. The mounting ring may include a cylindrical ring base, a downwardly extending flange engagable with the light transmission module groove, the flange including a top edge disposed axially outward from the base wherein the catch is engagable with the flange top edge, a grommet opening extending horizontally through the ring base and a plurality of threaded openings extending horizontally through the base. The lighted ring may include a plurality of set screws engagable with and extending through at least a portion of the threaded openings. The lighted ring may include a ring cap engagable with the module outer wall, the ring cap having a cap wall, an inwardly extending flange along a top edge of the cap wall, an inwardly extending lip along a bottom edge of the cap wall, a projection extending inwardly from the cap wall disposed between the inwardly extending flange and the inwardly extending lip, the light transmission module outer wall engagable between the inwardly extending lip and the projection. The cylindrical light transmission module may include a groove for placement of the light source. The light source may be a plurality of discrete LED lamps which are spaced apart. The light source may be powered by a replaceable internal battery. The light source may be powered by an internal rechargeable battery. The internal rechargeable battery may be recharged with a wired connection or an induction charger. The post may be a stanchion, seat pedestal or other column structure. The mounting ring may be a circular trapezoidal mounting ring and the cylindrical light transmission module is a circular trapezoidal light transmission module engageable with the circular trapezoidal mounting ring. The light source may comprise at least one incandescent lighting element.

Another aspect of the present invention is directed to a lighted ring for a post comprising a cylindrical light transmission module having an inner wall, a catch spaced axially outward from the inner wall the catch having an inwardly facing protrusion along an upper portion of the catch, a groove extending the entire circumference of the light transmission module between the inner wall and the catch, an outer wall spaced axially outward from the catch and a chamfer along a bottom edge of the light transmission module and a light module slot extending along a portion of the inner wall. The lighted ring includes a grommet disposed in the slot and a mounting ring having a cylindrical ring base, a downwardly extending flange engagable with the light transmission module groove, the flange including a top edge disposed axially outward from the base wherein the catch is engagable with the flange top edge, a grommet opening extending horizontally through the ring base and a plurality of threaded openings extending horizontally through the base. The lighted ring includes a plurality of set screws engagable with and extending through at least a portion of the threaded openings and a ring cap engagable with the module outer wall, the ring cap having a cap wall, an inwardly extending flange along a top edge of the cap wall, an inwardly extending lip along a bottom edge of the cap wall, a projection extending inwardly from the cap wall disposed between the inwardly extending flange and the inwardly extending lip, the light transmission module outer wall engagable between the inwardly extending lip and the projection. The lighted ring includes a light source disposed adjacent the light module. The lighted ring is disposable on and vertically slideable along the post. The light source provides illumination of an area adjacent the post through the chamfer. The transparent flange may extend outwardly from the bottom edge of the outer wall at an acute upward angle. The grommet may extend inwardly beyond the transparent ring inner wall to contact the post, providing a friction fit between the post and the transparent ring. The light source may be a plurality of spaced apart LEDs. The locking ring cylindrical locking wall slidingly may engage the transparent cylindrical wall and the locking ring flange is disposed adjacent the transparent ring top edge. The light source may be encapsulated to prevent water from contacting the light source. An outer circumferential edge of the transparent disk may be chamfered and a portion of the light traveling from the light source to the circumferential edge is directed in the direction of the chamfer. The light source may be disposed between the catch and the outer wall. The light source may be a plurality of spaced LEDs disposed between the catch and the outer wall.

Another aspect of the present invention is directed to a method for providing lighting to a boat surface comprising providing a post on the boat, the post having a post base and a post cylindrical surface and providing a lighted ring comprising a transparent ring having a cylindrical transparent wall, a top edge, a bottom edge, a plurality of grommet openings in the cylindrical wall extending to the top edge and a transparent flange extending outwardly from the bottom edge of the cylindrical wall, a light source disposed on the transparent ring and a plurality of grommets disposed in the grommet openings, a locking ring engagable with the transparent ring, the locking ring including a cylindrical locking wall and a locking ring flange extending radially inwardly from an upper edge of the cylindrical locking wall, and an LED light source in the transparent disk. The method includes sliding the transparent ring onto the post, sliding the locking ring onto the post above the transparent ring and engaging the locking ring with the transparent disk. The method includes connecting a power source to the LED light source wherein the light source provides illumination of the transparent flange, illuminating the area adjacent the post. The method may include the step of applying a force to the lighted ring in an upward or downward direction to place the lighted ring in a desired position wherein the force applied to the lighted ring overcomes the friction holding the lighted ring in place. The transparent disk may include a groove for placement of the light source. An outer circumferential edge of the transparent disk may be chamfered and a portion of the light traveling from the light source to the circumferential edge is directed in the direction of the chamfer.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

In describing the embodiment of the present invention, reference will be made herein to FIGS. 1-12 of the drawings in which like numerals refer to like features of the invention.

Figure 1:
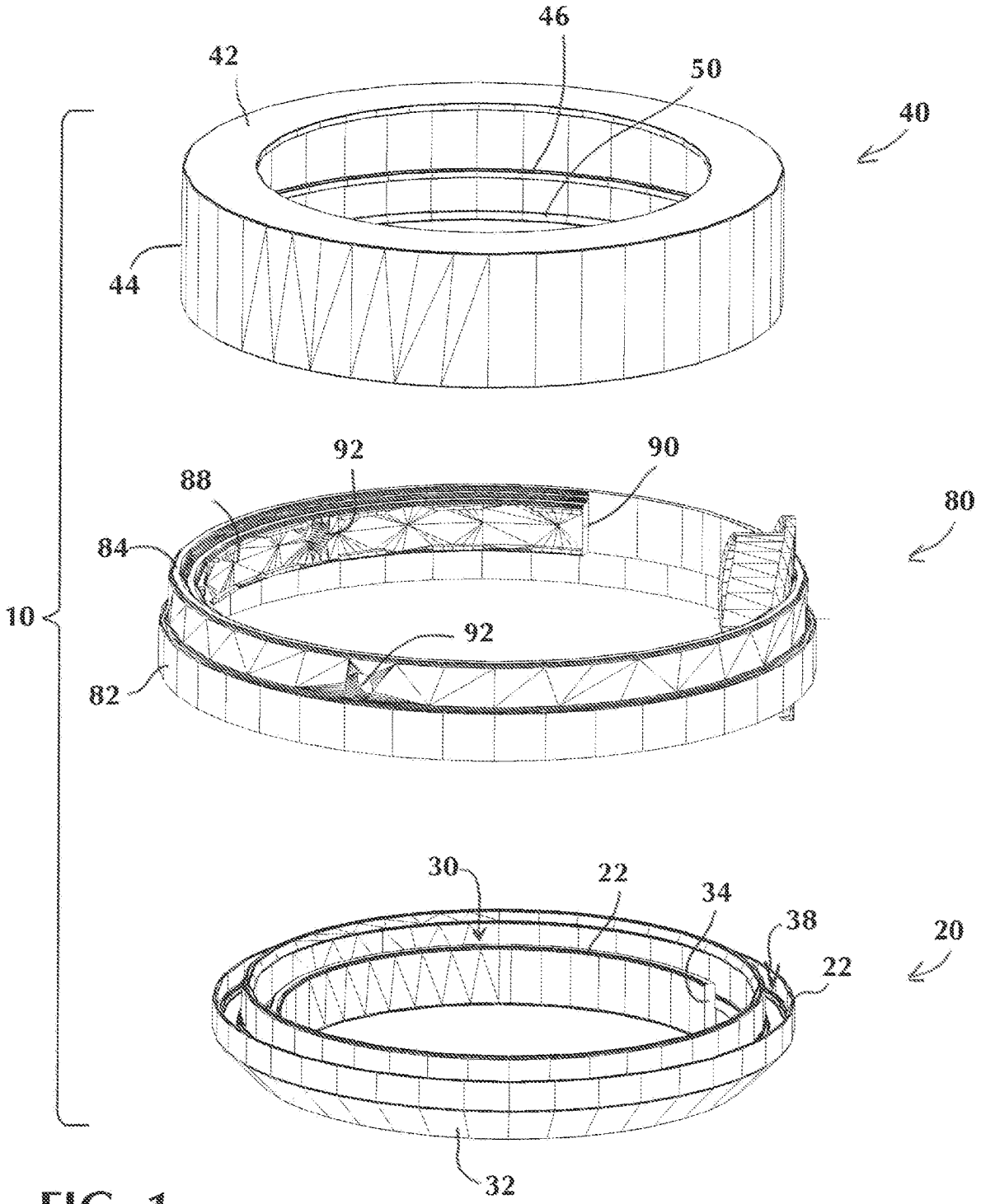
FIG. 1 is an exploded perspective view of the light ring according to the present invention.
Figure 2:
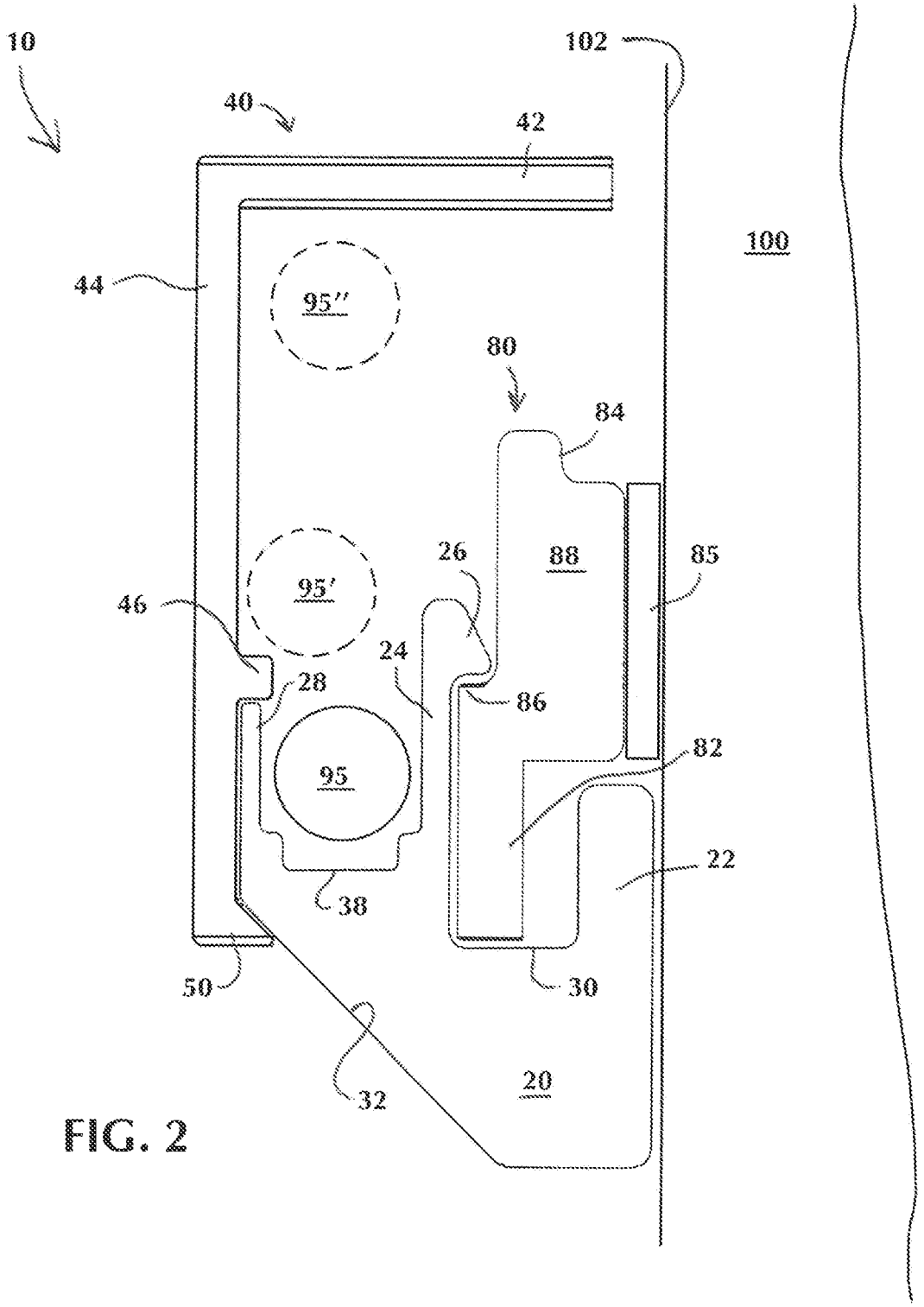
FIG. 2 is a profile cross sectional view of the light ring according to the present invention.
Figure 3:
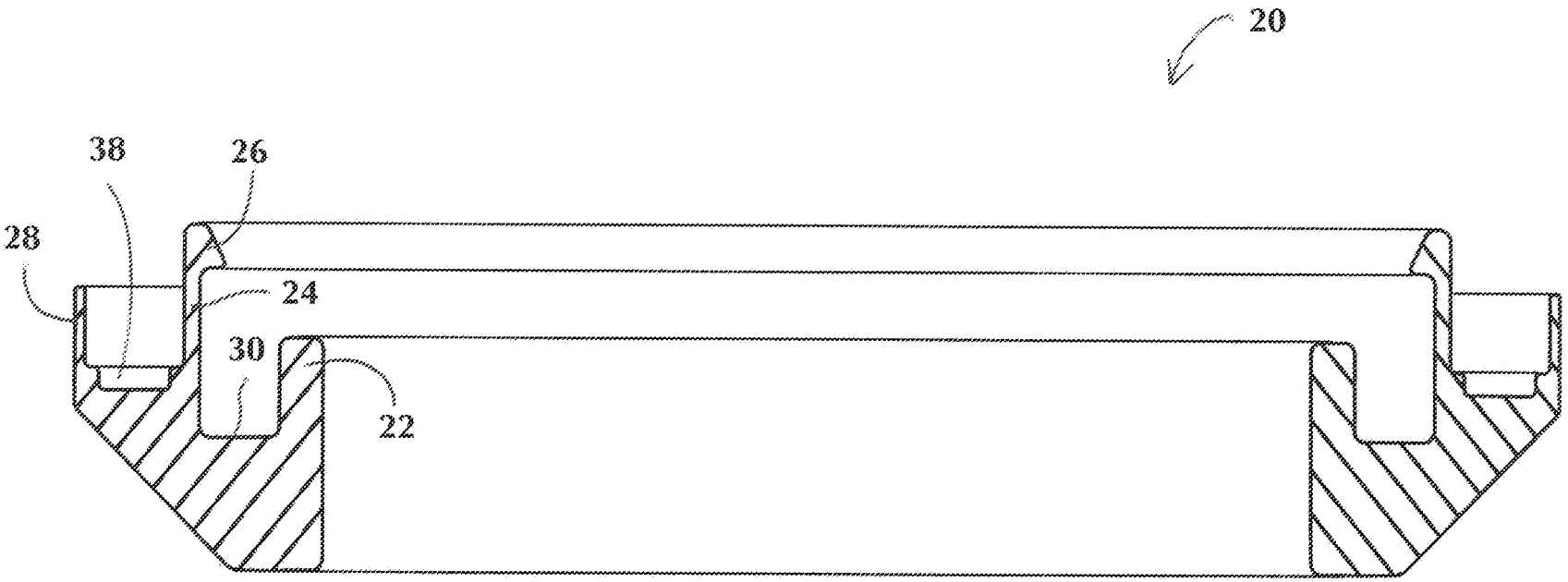
FIG. 3 is a cross sectional view of the light module or lens shown in FIG. 2.
Figure 4:
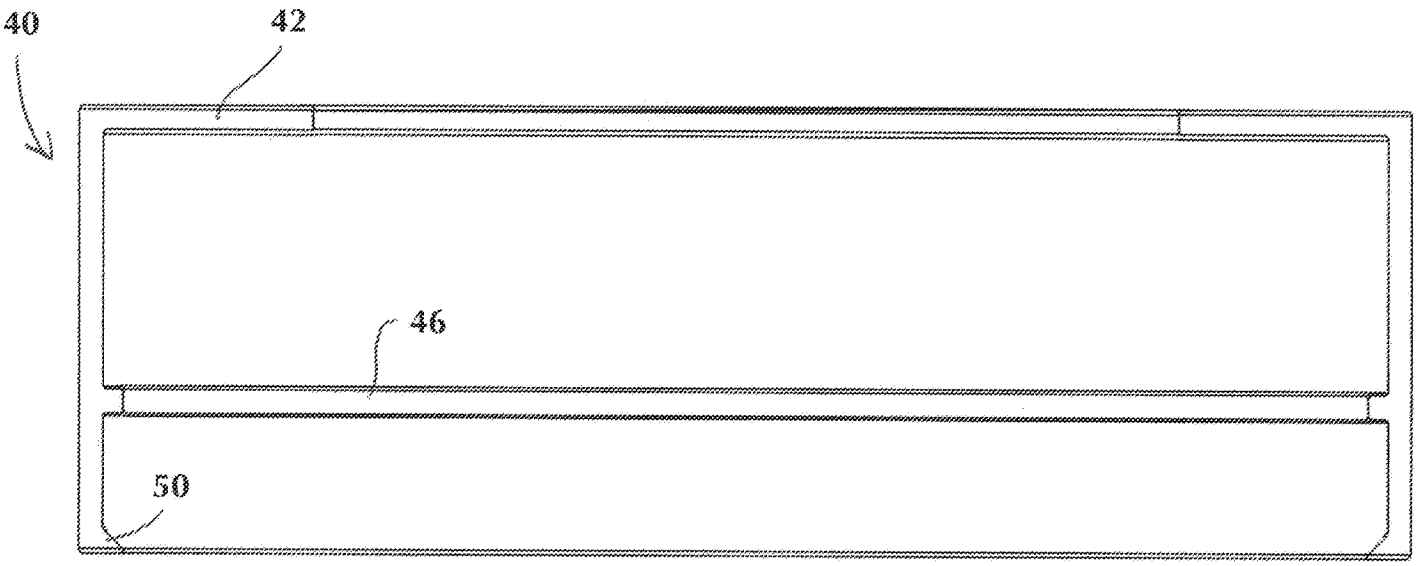
FIG. 4 is a cross sectional view of the light ring cap shown in FIG. 2.
Figure 5:
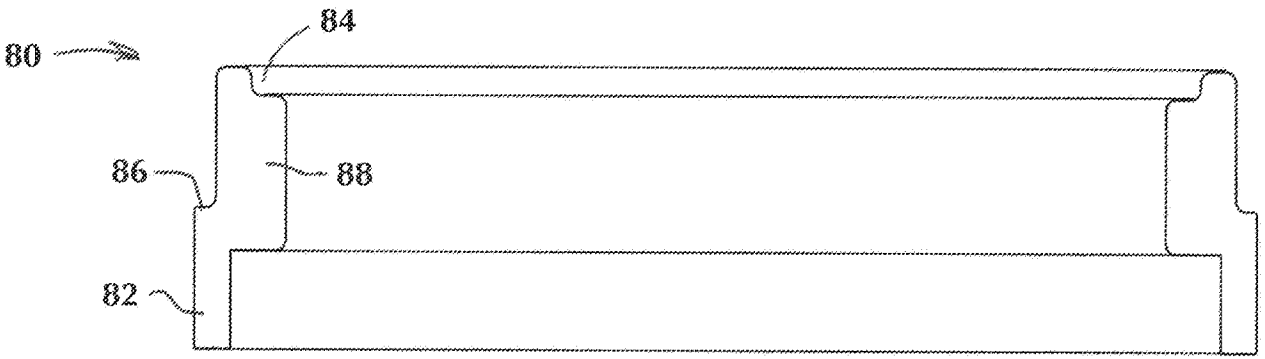
FIG. 5 is a cross sectional view of the mounting ring shown in FIG. 2.
Figure 6:
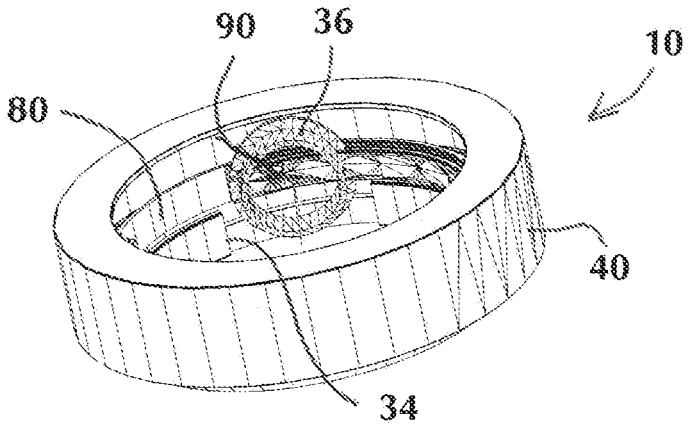
FIG. 6 is a top left perspective view of the assembled light ring shown in FIG. 1.
Figure 7:
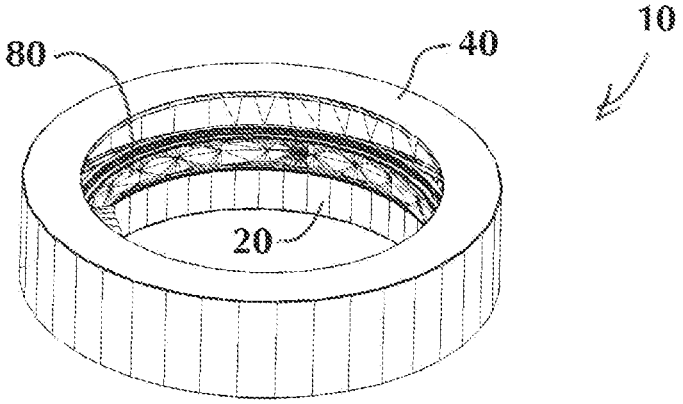
FIG. 7 is top right perspective view of the assembled light ring shown in FIG. 1.
Figure 8:
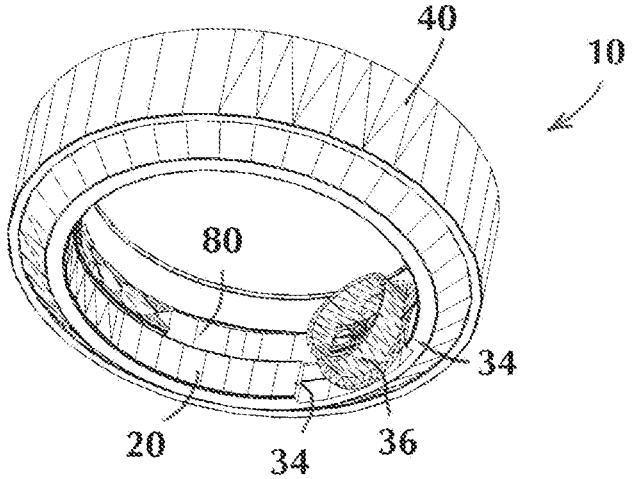
FIG. 8 bottom front perspective view of the assembled light ring shown in FIG. 1.

A lighted ring 10 for a post such as a stanchion, seat pedestal or other cylindrical column is shown in the exploded view of FIG. 1 and a cross sectional view showing the engagement of the components in FIG. 2. As shown in the cross-sectional view of FIG. 3, the lighted ring comprises a cylindrical light transmission module 20 having an inner wall 22 and a catch 24 spaced axially outward from the inner wall 22 the catch 24 having an inwardly facing protrusion 26 along an upper portion of the catch 24. The light transmission module 20 includes a groove 30 extending the entire circumference of the light transmission module 20 between the inner wall 22 and the catch 24 and an outer wall 28 spaced axially outward from the catch 24. The light transmission module 20 includes a chamfer 32 along a bottom edge of the light transmission module 20 and a light module slot 34 extending along a portion of the inner wall 22. The lighted ring 10 may include a grommet 36 disposed in the slot 34. The lighted ring 10 includes a mounting ring 80, shown in the cross-sectional view of FIG. 5, having a cylindrical ring base 88 and a downwardly extending flange 82 engagable with the light transmission module groove 30. The flange 82 includes a top edge 86 disposed axially outward from the base 88 wherein the catch 24 is engagable with the flange top edge 86. A grommet opening 90 extends horizontally through the ring base 88 and a plurality of threaded openings 92 extend horizontally through the ring base 88. The lighted ring 10 includes a plurality of set screws 70 engagable with and extending through at least a portion of the threaded openings 92. The lighted ring 10 includes a ring cap 40, shown in the cross-sectional view of FIG. 4, engagable with the module outer wall 28. The ring cap 40 includes a cap wall 44, an inwardly extending flange 42 along a top edge of the cap wall 44 and an inwardly extending lip 50 along a bottom edge of the cap wall 44. The ring cap 40 includes a projection 46 extending inwardly from the cap wall 44 disposed between the inwardly extending flange 42 and the inwardly extending lip 50. The light transmission module outer wall 28 is engagable between the inwardly extending lip 50 and the projection 46. A fastening strip 85 includes an adhesive on opposing strip surfaces and may be used to secure the mounting ring 88 to the outer surface 102 of the post 100. The lighted ring 10 includes a light source 95 disposed adjacent the light module 95 or in a light source groove 38 between the catch 24 and the outer wall 28. The lighted ring 10 may be disposable on and vertically slideable along the post 100 outer surface 102. The light source 95 provides illumination of an area adjacent the post 100 through the chamfer 32. The area adjacent the post 100 may include the post portion below the lighted ring as well as the base of the post and the substantially horizontal surface to which the post is attached. The post base may be a lower portion of the post attached directly to a substantially horizontal surface such as a marine vessel deck, a floor or the ground to which the post is attached. The post base may alternately extend outwardly from the post lower portion.

The grommet 36 may extend inwardly beyond the transparent ring inner wall 34 to contact the post 100, providing a friction fit between the post 100 and the transparent ring 20. The friction fit may be sufficient to prevent slippage of the lighted ring 10 on the post 100. The light source 95 may be a plurality of spaced apart LEDs or incandescent lamps and may be encapsulated to prevent water from contacting the light source. The light source may be any component which produces light, including LEDs, incandescent lamps or luminescent "glow" elements. The transparent disk may include a groove 38 for placement of the light source 95. The outer circumferential edge 32 of the transparent disk 20 may be chamfered whereby a portion of the light traveling from the light source to the circumferential edge is directed in the direction the chamfer.

Figure 9:
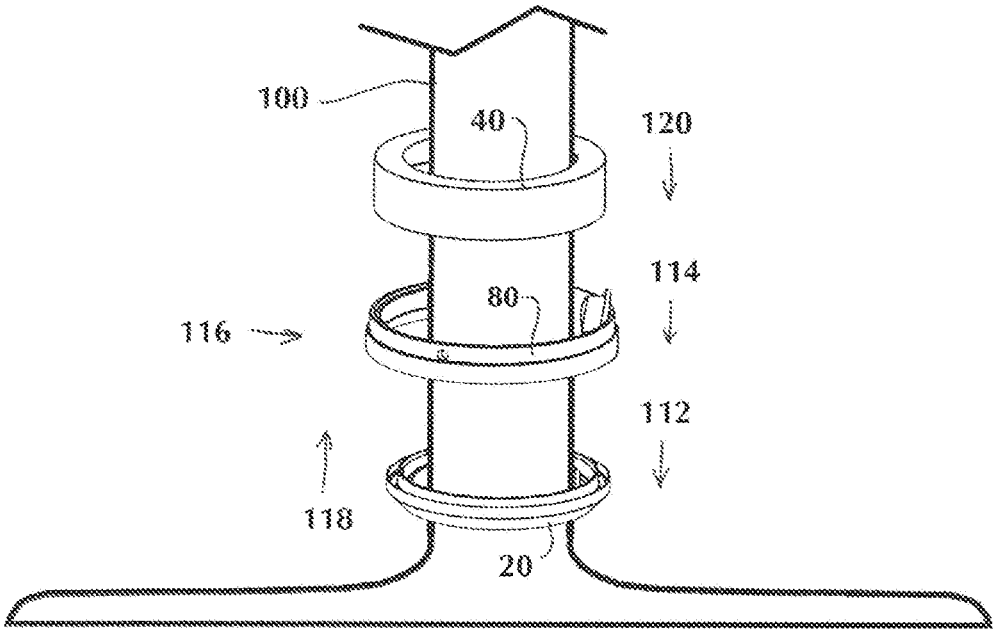
FIGS. 9 and 10 shows the step in securing the lighted ring to a post according to the present invention.
Figure 10:
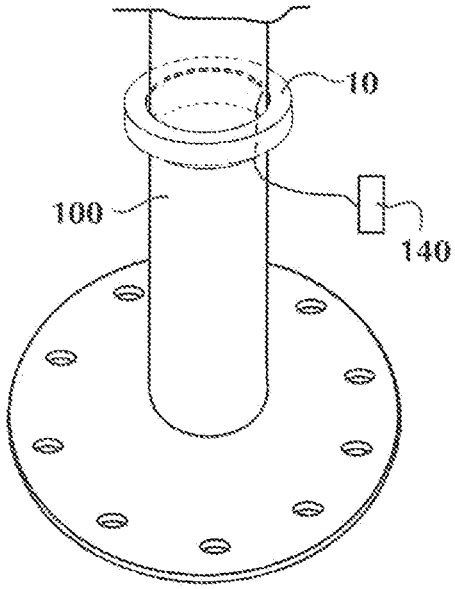

A method for providing lighting to a boat surface shown in FIGS. 9 and 10 includes sliding the transparent ring 20 onto the post 100 in the direction of arrow 112 and sliding the locking ring 80 onto the post 100 above the transparent ring 20 in the direction of arrow 114. The method may include securing the mounting ring 80 to the post 100 using a set screw in the direction of arrow 116 or using an adhesive to secure the body 88 of mounting ring 80 to the post 100. The method includes sliding the transparent ring 20 in the direction of arrow 118 to engage with the mounting ring 80. The method may include sliding the cap 40 onto the post 100 in the direction of arrow 120 and engaging the cap 40 with the transparent ring 20. The method may include connecting a power source 140 to a wire connecting the LED light to the power source wherein the light source provides illumination of the transparent flange, illuminating the area adjacent the post. The power source may be a marine battery or other power source on board. The power source may alternately be an internal battery that is either replaceable or rechargeable. A rechargeable battery may be charged using a standard wired battery charger or a wireless recharger placed adjacent the lighted ring to provide an induction-based charge.

Figure 11:
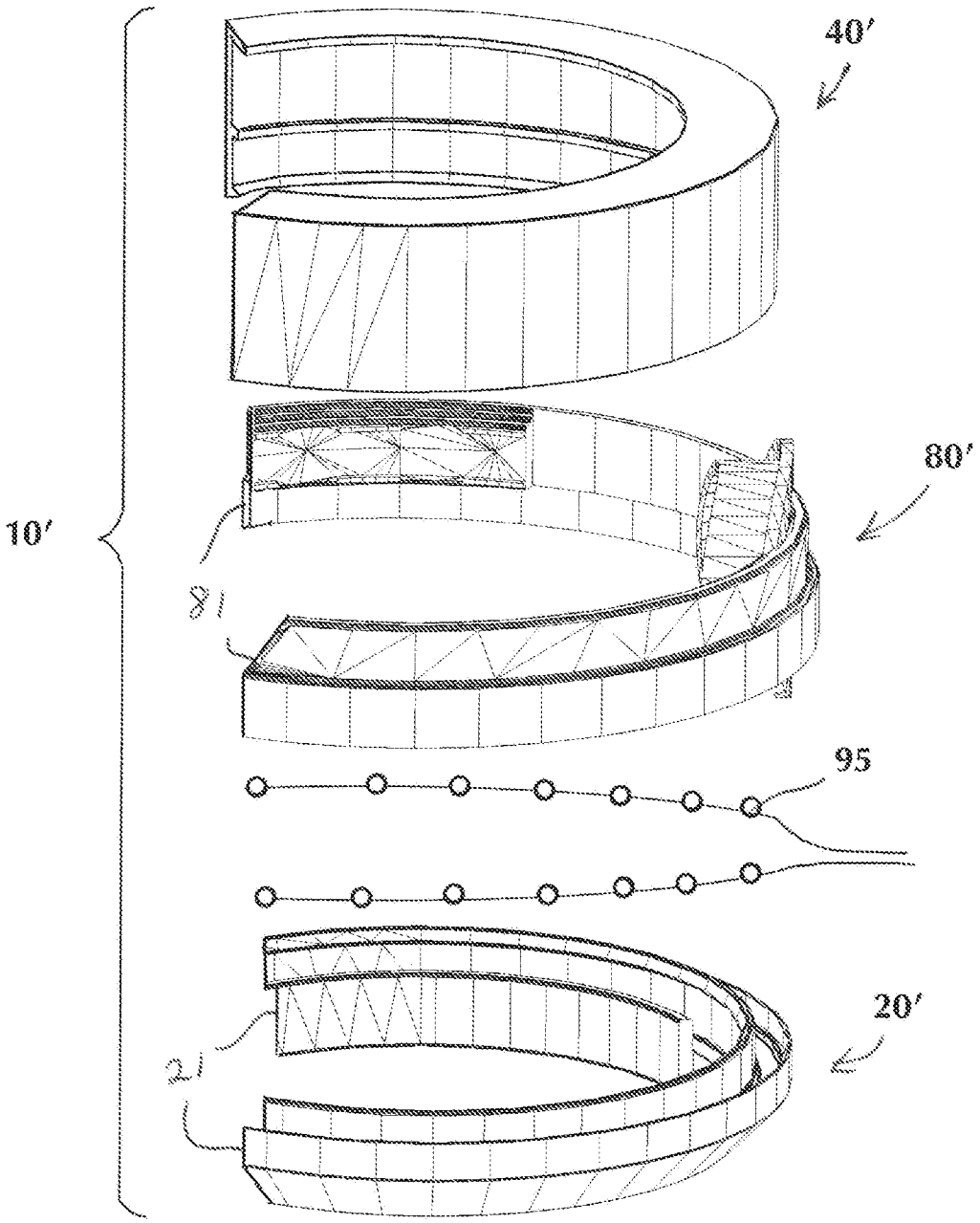
FIG. 11 is an exploded perspective view of a second embodiment of the light ring according to the present invention.

Another embodiment of the lighted ring is shown in FIG. 11. The lighted ring 10' may include a semicircular mounting ring 80' having the same structure as mounting ring 80 with an angular portion removed. More specifically the semicircular mounting ring 80' is a circular trapezoidal mounting ring. The mounting ring 80' has mounting ring ends 81 spaced an angular distance a from one another. The semicircular light transmission module 20' includes module ends 21 which align with mounting ring ends 81 when the light transmission module 20' is engaged and secured to mounting ring 80'. More specifically, the semi-circular light transmission module 20' is a circular trapezoidal light transmission module engageable with the circular trapezoidal mounting ring.

Figure 12:
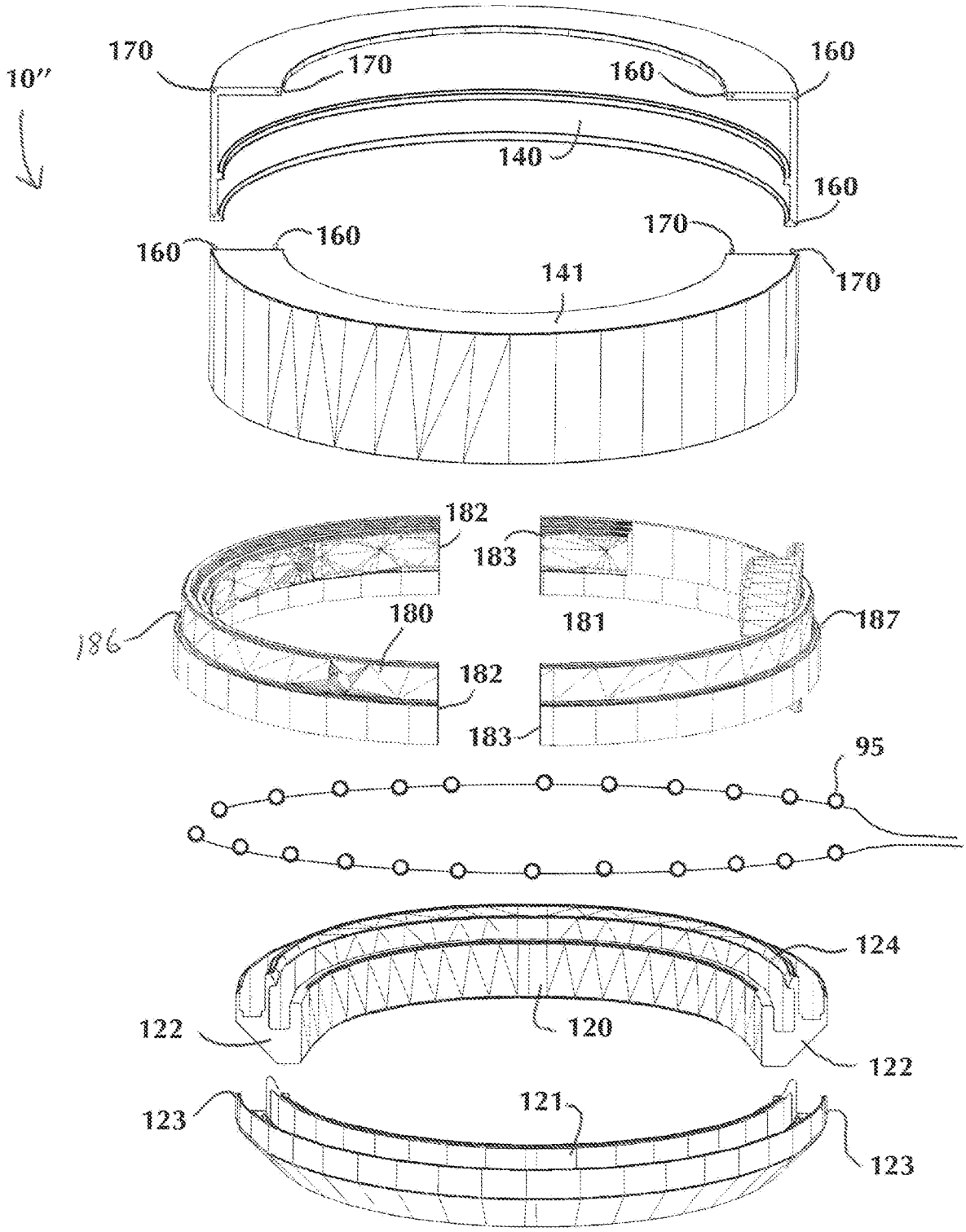
FIG. 12 is an exploded perspective view of a third embodiment of the light ring according to the present invention.

Another embodiment of the lighted ring is shown in FIG. 12. The lighted ring 10" may include a pair of semicircular mounting ring halves 180, 181 which when secured together have the same structure as mounting ring 80. The light transmission module 20" includes module halves 120,121 which correspond when secured together have the same structure as transmission ring 20. The transmission modules halves 120, 121 are disposed at 90° or other angle to the mounting ring halves 180, 181 when the lighted ring 10' is in the mountable or mounted position. When installed, the lighted ring 10' is held together as well as secured to the post when the light transmission module catch 24' engages the mounting ring flange top edge 86. Additionally, a pair of cap halves 140, 141 may engage the transmission module 20" with each cap half having a securing protrusion 160 engagable and plastically lockable with a cap half securing opening 170 on the opposite cap half.

A method for mounting the lighted ring 10" includes placing the first and second mounting ring halves 180, 181 around a post, placing the first and second light transmission module halves 120, 121 around the post below the mounting ring halves 180, 181, securing the light source 95 into the light source groove 38, threading the light source power wires 96 and engaging the catches 124, 125 on the light transmission module halves 120, 121 respectively with the first and second flange top edges 186, 187 on the mounting ring halves 180, 181 respectively. Once the catches 124, 125 are engaged at 90° to the flange top edges 186, 187, the light transmission module halves 120, 121 secure the mounting ring halves 180, 181 together and the mounting ring halves 180, 181 secure the light transmission module halves 120, 121 together. The cap halves 140, 141 may then be secured at about 90° to the light transmission module halves 120, 121, snapping the securing protrusions 160 into the corresponding cap half securing openings 170.

The lighted ring as described above provides a method for lighting a boat surface and more specifically provides a lighted ring and method of using the lighted ring for a post to illuminate an area adjacent the post for aesthetic and lighting purposes. The post has an illuminated portion for allowing a passenger or crew member to easily identify the post in low lighting conditions. An illuminated post is provided for allowing boaters to see a walkway in low light conditions.

While the present invention has been particularly described, in conjunction with a specific embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A lighted ring for a post comprising:

a cylindrical light transmission module; and a light source disposed adjacent the light module;

wherein the lighted ring provides illumination of an area adjacent the post; and wherein the light transmission module includes an inner wall, a catch spaced axially outward from the inner wall, the catch having an inwardly facing protrusion along an upper portion of the catch, a groove extending the entire circumference of the light transmission module between the inner wall and the catch, an outer wall spaced axially outward from the catch and a chamfer along a bottom edge of the light transmission module and a light module slot extending along a portion of the inner wall.

2. The lighted ring of claim 1 including a mounting ring securable on the post wherein the cylindrical light transmission module is engageable with the mounting ring.

3. The lighted ring of claim 2 wherein the mounting ring comprised a pair of semi-circular mounting ring portions and the cylindrical light transmission module comprises a pair of semi-circular light transmission module portions engagable with the semi-circular mounting ring portions whereby the engagement of the semi-circular light transmission module and semi-circular mounting ring portions secure the lighted ring on the post.

4. The lighted ring of claim 1 wherein the light source provides illumination of an area adjacent the post through the chamfer.

5. The lighted ring of claim 1 including a grommet disposed in the light module slot.

6. The lighted ring of claim 1 wherein the mounting ring includes a cylindrical ring base, a downwardly extending flange engagable with the light transmission module groove, the flange including a top edge disposed axially outward from the base wherein the catch is engagable with the flange top edge, a grommet opening extending horizontally through the ring base and a plurality of threaded openings extending horizontally through the base.

7. The lighted ring of claim 6 including a plurality of set screws engagable with and extending through at least a portion of the threaded openings.

8. The lighted ring of claim 6 including a ring cap engagable with the module outer wall, the ring cap having a cap wall, an inwardly extending flange along a top edge of the cap wall, an inwardly extending lip along a bottom edge of the cap wall, a projection extending inwardly from the cap wall disposed between the inwardly extending flange and the inwardly extending lip, the light transmission module outer wall engagable between the inwardly extending lip and the projection.

9. The lighted ring of claim 1 wherein the light source is a plurality of discrete LED lamps which are spaced apart.

10. The lighted ring of claim 1 wherein the light source is powered by a replaceable internal battery.

11. The lighted ring of claim 1 wherein the light source is powered by an internal rechargeable battery.

12. The lighted ring of claim 11 wherein the internal rechargeable battery is recharged with a wired connection or an induction charger.

13. The lighted ring of claim 1 wherein the post is a stanchion or a seat pedestal.

14. The lighted ring of claim 1 wherein the light source comprises at least one incandescent lighting element.

15. A lighted ring for a post comprising:

a cylindrical light transmission module;

a light source disposed adjacent the light module; and a mounting ring securable on the post wherein the cylindrical light transmission module is engageable with the mounting ring;

wherein the lighted ring provides illumination of an area adjacent the post; and wherein the mounting ring is a circular trapezoidal mounting ring and the cylindrical light transmission module is a circular trapezoidal light transmission module engageable with the circular trapezoidal mounting ring.

16. A lighted ring for a post comprising:

a cylindrical light transmission module having an inner wall, a catch spaced axially outward from the inner wall the catch having an inwardly facing protrusion along an upper portion of the catch, a groove extending the entire circumference of the light transmission module between the inner wall and the catch, an outer wall spaced axially outward from the catch and a chamfer along a bottom edge of the light transmission module and a light module slot extending along a portion of the inner wall;

a grommet disposed in the slot;

a mounting ring having a cylindrical ring base, a downwardly extending flange engagable with the light transmission module groove, the flange including a top edge disposed axially outward from the base wherein the catch is engagable with the flange top edge, a grommet opening extending horizontally through the ring base and a plurality of threaded openings extending horizontally through the base;

a plurality of set screws engagable with and extending through at least a portion of the threaded openings; and a ring cap engagable with the module outer wall, the ring cap having a cap wall, an inwardly extending flange along a top edge of the cap wall, an inwardly extending lip along a bottom edge of the cap wall, a projection extending inwardly from the cap wall disposed between the inwardly extending flange and the inwardly extending lip, the light transmission module outer wall engagable between the inwardly extending lip and the projection;

a light source disposed adjacent the light module;

wherein the lighted ring is disposable on the post; and wherein the light source provides illumination of an area adjacent the post through the chamfer.

17. The lighted ring of claim 16 wherein the transparent flange extends outwardly from the bottom edge of the outer wall at an acute upward angle.

18. The lighted ring of claim 16 wherein the grommet extends inwardly beyond the transparent ring inner wall to contact the post, providing a friction fit between the post and the transparent ring.

19. The lighted ring of claim 16 wherein the light source is a plurality of spaced apart LEDs.

20. The lighted ring of claim 16 wherein the locking ring cylindrical locking wall slidingly engages the transparent cylindrical wall and the locking ring flange is disposed adjacent the transparent ring top edge.

21. The lighted ring of claim 16 wherein the light source is encapsulated to prevent water from contacting the light source.

22. The lighted ring of claim 16 wherein an outer circumferential edge of the transparent disk is chamfered and a portion of the light traveling from the light source to the circumferential edge is directed in the direction the chamfer.

23. The lighted ring of claim 16 wherein the light source is disposed between the catch and the outer wall.

24. The lighted ring of claim 16 wherein the light source is a plurality of spaced LEDs disposed between the catch and the outer wall.

25. A method for providing lighting to a boat surface comprising:

providing a post on the boat, the post having post base and a post column;

providing a lighted ring comprising a transparent ring having a cylindrical transparent wall, a top edge, a bottom edge and a transparent flange extending outwardly from the bottom edge of the cylindrical wall; a light source disposed on the transparent ring; and a mounting ring engagable with the transparent ring and mountable on the post;

sliding the transparent ring onto the post;

sliding the locking ring onto the post column above the transparent ring;

securing the mounting ring to the post;

engaging the locking ring with the transparent disk; and connecting a power source to the light source; wherein the light source provides illumination of the transparent flange, illuminating the area adjacent the post.

26. The method of claim 25 including the step of applying a force to the lighted ring in an upward or downward direction to place the lighted ring is a desired position wherein the force applied to the lighted ring overcomes the friction holding the lighted ring in place.

27. The method of claim 25 wherein the transparent disk includes a groove for placement of the light source.

28. The method of claim 25 wherein an outer circumferential edge of the transparent disk is chamfered and a portion of the light traveling from the light source to the circumferential edge is directed in the direction the chamfer.

* * * * *